US010100260B2

(12) United States Patent
Pagot

(10) Patent No.: US 10,100,260 B2
(45) Date of Patent: Oct. 16, 2018

(54) PROCESS FOR THE TREATMENT OF A HYDROCARBON FEED COMPRISING HYDROGEN AND C1 TO C4 HYDROCARBONS

(71) Applicant: IFP ENERGIES NOUVELLES, Rueil-Malmaison (FR)

(72) Inventor: Alexandre Pagot, St. Genis Laval (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 0 days.

(21) Appl. No.: 15/210,496

(22) Filed: Jul. 14, 2016

(65) Prior Publication Data

US 2017/0015914 A1 Jan. 19, 2017

(30) Foreign Application Priority Data

Jul. 15, 2015 (FR) ..... 15 56669

(51) Int. Cl.

| | |
|---|---|
| ***C10G 49/22*** | (2006.01) |
| ***C10G 7/00*** | (2006.01) |
| ***C10G 70/00*** | (2006.01) |
| ***C10G 70/04*** | (2006.01) |
| ***C10G 70/06*** | (2006.01) |

(52) U.S. Cl.

CPC ..... *C10G 7/00* (2013.01); *C10G 70/00* (2013.01); *C10G 70/04* (2013.01); *C10G 70/041* (2013.01); *C10G 70/043* (2013.01); *C10G 70/046* (2013.01); *C10G 70/06* (2013.01); *C10G 2300/4081* (2013.01)

(58) Field of Classification Search

CPC ..... C10G 49/22; C10G 5/00

See application file for complete search history.

(56) References Cited

U.S. PATENT DOCUMENTS

| | | | | |
|---|---|---|---|---|
| 3,431,195 | A | 3/1969 | Storch et al. | |
| 4,374,726 | A | 2/1983 | Schmelzer et al. | |
| 4,568,451 | A * | 2/1986 | Greenwood | C10G 49/22 208/100 |
| 4,673,488 | A * | 6/1987 | Turner | C10G 49/22 208/101 |
| 7,452,458 | B2 | 11/2008 | Sanchez et al. | |
| 8,882,890 | B2 | 11/2014 | Rosser et al. | |
| 2006/0021914 | A1 | 2/2006 | Sanchez et al. | |
| 2006/0032787 | A1 * | 2/2006 | Sanchez | C10G 21/00 208/102 |

OTHER PUBLICATIONS

French Search Report for FR15/56.669 dated May 10, 2016.

* cited by examiner

*Primary Examiner* — Michelle Stein

(74) *Attorney, Agent, or Firm* — Millen White Zelano and Branigan, PC; John Sopp

(57) ABSTRACT

The present invention concerns a process for the treatment of a hydrocarbon feed containing hydrogen and hydrocarbons including $C_1$ to $C_4$ hydrocarbons, employing a first and a second recontacting step and in which the gaseous effluent obtained from the second recontacting step is recycled to the first recontacting step. The process is of particular application to the treatment of a hydrocarbon feed obtained from catalytic reforming with a view to recovering hydrogen and $C_3$ and $C_4$ hydrocarbons.

10 Claims, 1 Drawing Sheet

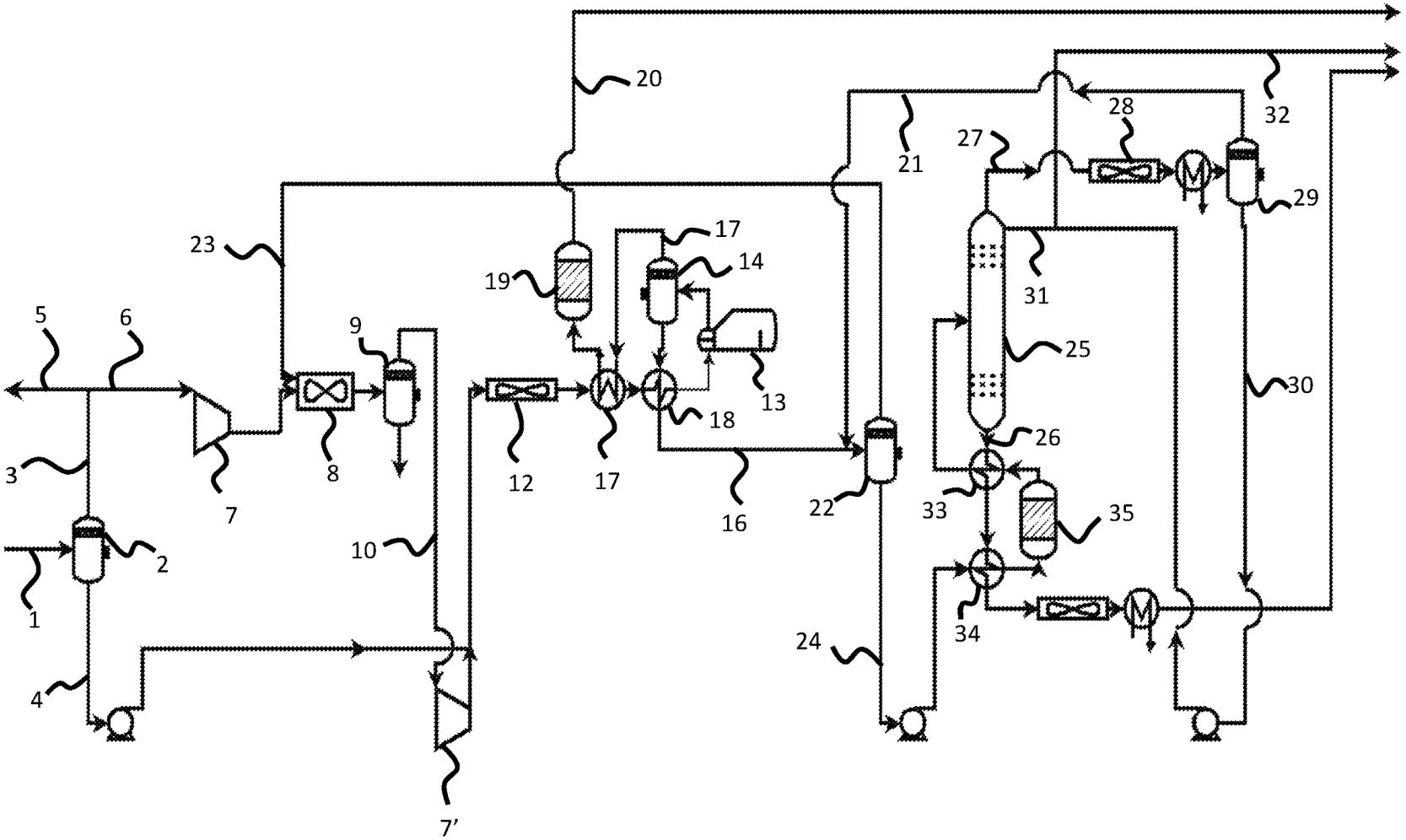
1
2
3
4
5
6
7
7'
8
9
10
12
13
14
16
17
17
18
19
20
21
22
23
24
25
26
27
28
29
30
31
32
33
34
35

PROCESS FOR THE TREATMENT OF A HYDROCARBON FEED COMPRISING HYDROGEN AND C1 TO C4 HYDROCARBONS

The present invention relates to the field of the treatment of effluents from units for the conversion or refining of petroleum or petrochemicals which comprise hydrogen as well as hydrocarbons such as: methane, ethane, propane, butane, hydrocarbon fractions containing 5 to 11 carbon atoms (denoted $C_5$-$C_{11}$), and optionally heavier hydrocarbons such as hydrocarbons containing in the range 12 to 30 carbon atoms ($C_{12}$-$C_{30}$) or more, usually in small quantities.

In particular, it relates to the treatment of an effluent from catalytic reforming or from the aromatization of fractions with a distillation range in the gasoline range (essentially containing 6 to 11 carbon atoms, i.e. typically 80° C. to 220° C.), which can be used to provide an aromatic reformate, a hydrogen-rich gas and a liquefied petroleum gas (or "LPG") essentially comprising hydrocarbons containing three or four carbon atoms (propane and/or propylene and/or butane and/or butenes and/or butadiene, and mixtures thereof). The presence of $C_3$ and $C_4$ hydrocarbons in the catalytic reforming effluents is primarily linked to hydrocracking reactions which take place concomitantly with the dehydrogenation reactions.

The invention is also applicable to dehydrogenation effluents, for example butane, or pentane, or higher hydrocarbons, for example fractions essentially comprising hydrocarbons containing 10 to 14 carbon atoms, the olefins of which are used downstream for the production of linear alkylbenzenes.

The process in accordance with the invention may also be applicable to the hydrotreatment (and/or hydrodesulphurization and/or hydrodemetallization and/or total or selective hydrogenation) of all hydrocarbon cuts such as naphtha, gasoline, kerosene, light gas oil, heavy gas oil, vacuum distillate, or vacuum residue. More generally, it is applicable to any effluent comprising hydrogen, light hydrocarbons (methane and/or ethane), $C_3$ and $C_4$ hydrocarbons as well as heavier hydrocarbons.

PRIOR ART

The known prior art document U.S. Pat. No. 4,673,488 discloses a process for recovering light hydrocarbons from a reaction effluent containing hydrogen obtained from a reaction for the conversion of a hydrocarbon feed, which comprises:

- passing the partially condensed effluent comprising $C_5^+$ hydrocarbons, methane, ethane, propane, butane and hydrogen into a vapour-liquid separation zone which comprises at least two vapour-liquid separators and in which at least one vapour-liquid recontacting step is carried out;
- separating the effluent obtained after the vapour-liquid separation zone into a hydrogen-rich gas stream and a stream of liquid hydrocarbons;
- passing the liquid hydrocarbon stream into a fractionation zone comprising at least one fractionation column in a manner such as to recover a stream of heavy hydrocarbons, an overhead vapour stream and an overhead liquid stream; and
- recycling a portion of the overhead vapour stream to said vapour-liquid separation zone.

In other known processes, in particular as described in the document FR 2 873 710, the hydrocarbon effluent is sent, after recovering a hydrogen-rich gas, to a step for separation in a recontacting column in order to separate a first gaseous effluent from a liquid effluent, and this liquid effluent is sent to a stabilization step during which a stabilized reformate, a liquefied petroleum gas and a second gaseous effluent are recovered, the latter being recycled to the separation step. The first gaseous effluent obtained during the separation step, which contains substantial quantities of $C_1$, $C_2$ hydrocarbons and also hydrogen and $C_3$ and $C_4$ hydrocarbons, is conventionally used as a fuel gas. The term "stabilized" for a reformate (or another stabilized liquid in accordance with the invention) denotes a reformate (or other liquid) which has been distilled in order to eliminate the major portion, and generally substantially all, of the compounds containing 4 carbon atoms or fewer ($C_4^-$).

One aim of the invention is to provide a process that can be used to maximize the recovery of hydrogen and $C_3$ and $C_4$ hydrocarbons which can be put to better use than if simply consumed as fuel gas in the refinery.

SUMMARY OF THE INVENTION

Thus, the present invention concerns a process for the treatment of a hydrocarbon feed containing a gaseous phase comprising hydrogen and a hydrocarbon phase including $C_1$ to $C_4$ hydrocarbons, in which:

a) the hydrocarbon feed is separated into a gaseous phase containing mainly hydrogen and a liquid phase containing hydrocarbons;

b) a first recontacting step is carried out on the gaseous phase obtained from step a) mixed with a gaseous recycling stream obtained from step e) and with the liquid phase obtained from step a) at a temperature of 55° C. or less;

c) the recontacting effluent from step b) is separated into a hydrogen-rich gaseous phase and a liquid phase;

d) a second recontacting step is carried out on the liquid phase obtained from step c) with a gas phase obtained from step f) at a temperature of 55° C. or less;

e) the recontacting effluent obtained from step d) is separated into a gaseous phase which is recycled to step b) and a liquid phase containing hydrocarbons;

f) the liquid phase obtained from step e) is fractionated in a fractionation column in a manner such as to separate a gaseous overhead fraction and a liquid bottom fraction containing hydrocarbons containing more than 4 carbon atoms;

g) the gaseous overhead fraction obtained from step f) is partially condensed and a liquid phase containing mainly $C_3$ and $C_4$ hydrocarbons and a gaseous phase which is recycled to step d) are separated out.

Thus, because the gaseous fraction recovered after the fractionation of step g) (or stabilization) is recycled to the second recontacting step, a gaseous effluent can be recovered which is itself recycled to the first recontacting step, and so the recovery yield obtained for $C_3$ and $C_4$ hydrocarbon compounds is improved, along with the hydrogen recovery.

The term "recontacting" denotes an operation which can be used to extract compounds contained in a gaseous phase by means of a liquid phase which has an absorption capacity by bringing the two phases into contact. As an example, recontacting may be carried out by carrying out direct contact by in-line mixing of liquid and gaseous phases.

Advantageously, the hydrocarbon feed which is treated by the process is an effluent produced by a catalytic reforming process.

In a preferred embodiment, the separation steps c) and e) are carried out by means of a separator drum.

These embodiments are advantageous from the point of view of implementation because they involve equipment which is simpler to manage and which incur lower investment costs, in particular compared with a recontacting column.

The first recontacting step is preferably carried out at a temperature in the range −20° C. to 55° C. The second recontacting step is preferably carried out at a temperature in the range 10° C. to 55° C.

Preferably, step b) is carried out with the gaseous phase compressed to a pressure in the range 1.6 to 4.0 MPa.

Preferably, the liquid bottom fraction containing hydrocarbons obtained from step f) is supplied to a heat exchange device in order to heat the liquid phase containing hydrocarbons obtained from step e).

Advantageously, the hydrogen-rich gaseous phase and/or the liquid phase obtained from step c) are supplied to at least one heat exchanger in order to cool the gas/liquid mixture at step b).

DETAILED DESCRIPTION OF THE INVENTION

Further characteristics and advantages of the invention will become apparent from the following description, given solely by way of non-limiting illustration and made with reference to the accompanying FIG. 1 which represents a flow diagram of a specific arrangement of the process in accordance with the invention.

The feed which is treated by the process is, for example, an effluent from a catalytic reforming unit, dehydrogenation effluents, for example butane or pentane, or higher hydrocarbons, for example fractions essentially comprising hydrocarbons containing 10 to 14 carbon atoms, the olefins of which are used downstream for the manufacture of linear alkylbenzenes (generally termed LAB).

The process in accordance with the invention may also be applied to effluents from hydrotreatment units (hydrodesulphurization, hydrodemetallization, total or selective hydrogenation) of any hydrocarbon cuts such as naphtha, gasoline, kerosene, light gas oil, heavy gas oil, vacuum distillate, or vacuum residue. More generally, it is applicable to any effluent comprising hydrogen, light hydrocarbons (methane and/or ethane), LPGs (propane and/or butane) and heavier hydrocarbons.

Preferably, the process in accordance with the invention can be used to treat effluents obtained from catalytic reforming units.

Referring to FIG. 1, the hydrocarbon feed containing a gaseous phase comprising hydrogen and a hydrocarbon phase including $C_1$, $C_2$, $C_3$ and $C_4$ hydrocarbons is sent via the line 1 to a gas-liquid separation device 2 which may be a gas-liquid separator drum which is known to the person skilled in the art. The separation device 2 allows recovering a gaseous phase 3 and a liquid fraction 4, respectively from the head and bottom of said device 2. As indicated in FIG. 1, the gaseous overhead fraction 3, which mainly contains hydrogen and light $C_1$, $C_2$, $C_3$ and $C_4$ hydrocarbons, may be divided into two streams 5 and 6. The stream 5 is recycled to a reaction unit located upstream, for example a catalytic reforming unit, as a recycle gas. The stream 6 of gas is compressed using a compressor 7 and then sent to a cooling system 8. The gas 6 is typically compressed to a pressure in the range 0.6 to 1.0 MPa. In accordance with the invention, the compressed gas 6 is mixed with a recycle gas, supplied via the line 23, the origin of which is detailed below. This mixture is cooled to a temperature of less than 55° C., for example. The effluent obtained from the cooling system 8 is transferred to a separator drum to recover a gas 10 which is purified of liquid hydrocarbons which have condensed by cooling.

The cooled gas 10 is compressed, using a compressor 11, to a pressure which is generally in the range 1.6 to 4.0 MPa. The compressed gas 10 undergoes a low temperature recontacting step carried out in the presence of the liquid hydrocarbon phase 4 obtained from the gas-liquid separation device 2.

The liquid hydrocarbon fraction 4 is employed as an adsorbent in order to recover the light hydrocarbons ($C_1$ to $C_4$) present in the gas 10. To this end, the gas 10 is mixed with the liquid hydrocarbon fraction 4 in order to carry out a recontacting step, then the mixture is cooled to a temperature of 55° C. or less, preferably in the range −20° C. to 55° C. As indicated in FIG. 1, cooling of the mixture may be carried out by means of an air cooler 12 and a chiller 13. The gas-liquid mixture is transferred to a separator drum 14 in which gas/liquid separation is carried out in order to recover the $C_3$ and $C_4$ hydrocarbons contained in the gas 10 into the liquid phase. Thus, a hydrogen-rich gas 15 is withdrawn overhead from the separator drum 14 as a mixture with $C_1$ and $C_2$ hydrocarbons, and a liquid hydrocarbon effluent 16 including $C_3$ and $C_4$ hydrocarbons is withdrawn from the bottom. Thus, recontacting is carried out in the line which brings the gas/liquid mixture from the air cooler 12 to the separation drum 14.

As indicated in FIG. 1, in order to reduce the power necessary to operate the chiller 13, at least one indirect heat exchange system is used which is, for example, supplied with the cooled gas 15 and/or with the liquid hydrocarbon effluent 16, to cool the gas-liquid mixture. The embodiment of FIG. 1 uses two indirect heat exchange systems 17 and 18 which respectively use the cooled gas 15 and the liquid hydrocarbon effluent 16 as the heat exchange fluid.

The hydrogen-rich gas 15 is evacuated from the treatment unit via the line 20 after optionally being passed through a guard bed 19 in order to adsorb the chlorine present in the gas when the hydrocarbon feed treated by the process is a catalytic reforming effluent.

In accordance with the process of the invention, the liquid hydrocarbon effluent 16, which still contains $C_3$ and $C_4$ hydrocarbons, is used as the adsorbent liquid in a second step for recontacting with a recycle gas supplied via the line 21 which is detailed below. The aim of the second recontacting step is to recover the $C_3$ and $C_4$ hydrocarbons contained in the recycle gas 21 with the liquid hydrocarbon effluent 16 as the absorption liquid.

The second recontacting step is carried out at a temperature which is higher than that of the first recontacting step, which is preferably in the range 10° C. to 55° C. This temperature results from the thermodynamic equilibrium of the absorption of the liquid 16 and the vapour 21. Preferably, no means for controlling the temperature (for example of the heat exchanger type) is used. Recontacting is thus carried out in-line, which feeds the mixture (liquid hydrocarbon effluent/recycle gas) towards the gas/liquid phase separation zone. As indicated in FIG. 1, the gas/liquid phase separation zone comprises a separator drum 22 which is operated in a manner such as to maximize the overhead recovery of hydrogen and $C_1$ and $C_2$ hydrocarbons. In accordance with the invention, the gaseous effluent containing hydrogen and $C_1$ and $C_2$ hydrocarbons is withdrawn via the line 23 to be recycled in its entirety as a mixture with the compressed gas 6 obtained from the separator drum 2.

A liquid effluent 24 having low content of hydrogen and $C_1$ and $C_2$ hydrocarbons, and essentially contains hydrocarbons containing three and more than three carbon atoms ($C_3^+$) and optionally a small quantity of $C_1$ and $C_2$ hydrocarbons, is obtained from the bottom of the second separator drum 22.

The liquid effluent 24 is heated for sending to a stabilization unit which is operated in a manner such as to recover a stabilized liquid hydrocarbon effluent and a liquid distillate obtained from the reflux drum of the stabilization unit which contains mainly $C_3$ and $C_4$ hydrocarbons. The stabilization unit comprises a distillation column 25 the bottom of which is provided with a circulation conduit equipped with a recirculation circuit comprising a reboiler (not shown) and a conduit 26 for evacuation of the stabilized liquid effluent. The overhead gas from the column 25 moves in a conduit 27 connected to a condensation system comprising a cooling device 28 for the overhead gas and a reflux drum 29. The condensed liquid comprising the majority of the $C_3$ and $C_4$ hydrocarbons (or liquid distillate) separated in the reflux drum 29 is evacuated via the line 30 and divided into two streams: one stream is recycled to the column 25 via the line 31, while the complementary stream, which has not been recycled, is evacuated via the line 32. The residual gas withdrawn from the head of the reflux drum 29, which is not condensed and comprises substantial quantities of $C_3$ and $C_4$ hydrocarbons, is evacuated via the line 21 and recycled, as indicated above, to the drum 22 in order to undergo a recontacting step.

Still with reference to FIG. 1, the stabilized liquid effluent 26 recovered from the bottom of the distillation column advantageously serves to feed an indirect heat exchanger system 33, 34 in order to preheat the liquid effluent 24 before it enters the distillation column 25. This thermal integration can thus be used to reduce the heat energy which has to be supplied to the reboiler in order to operate the distillation column.

As indicated in FIG. 1, it is advantageous to provide a guard bed 35 upstream of the distillation column 25 configured to capture any chlorine which might be present in the liquid effluent 24 in the case in which the hydrocarbon feed treated by the process is a catalytic reforming unit effluent.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 15/56.669, filed Jul. 15, 2015, are incorporated by reference herein.

EXAMPLE

Example 1

Example 1 (comparative) illustrates the function of a treatment process illustrated in FIG. 1, but in which the gaseous effluent 23 is not recycled to the first recontacting step of the invention.

The treated hydrocarbon feed was an effluent (or reformate) obtained from catalytic reforming and had the composition given in Table 1:

TABLE 1

Composition of reformate

| | Reformate (kg/h) |
|---|---|
| H2 | 7 200 |
| C1 | 1 540 |
| C2 | 2 540 |
| C3 | 4 660 |
| C4 branched | 2 840 |
| C4 linear | 2 860 |
| C5+ | 178 360 |
| Total Kg/h | 200 000 |

The hydrocarbon feed was initially treated in a separator drum in order to separate a gaseous phase containing mainly hydrogen and a liquid phase containing hydrocarbons.

The gaseous phase 6 obtained from the separation step was compressed by compressors with the intermediate cooling steps necessary for the compressors to function properly, and was sent to the first recontacting step with the liquid phase 4 obtained from the separation step. Recontacting of the gas-liquid mixture was carried out in-line and the gas/liquid mixture, cooled to a temperature of 0° C., was separated in a separator drum which operated at a pressure of 3.18 MPa. A hydrogen-rich gas phase 20 and a liquid phase 16 containing hydrocarbons were withdrawn from the separator drum.

The liquid phase 16 was then brought into contact with a gaseous recycle phase 21 which came from the reflux drum of the distillation column. The second recontacting step was carried out in-line and the gas/liquid mixture was separated in a separator drum which was operated at a pressure of 1.03 MPa in a manner such as to provide a gas 23 which was not recycled to the first recontacting step, and a liquid phase 24. This gas 23 in accordance with the prior art was used as a fuel gas in furnaces.

The liquid phase 24 was fractionated in a fractionation column (stabilization column) in order to recover a gaseous overhead fraction 27 and a liquid bottom fraction 26 containing hydrocarbons containing more than 4 carbon atoms. This column was operated at a pressure of 1.05 MPa and a temperature of 43° C. at the reflux drum.

Next, the gaseous overhead fraction was condensed in a reflux drum, from which a liquid phase 30 and a gaseous phase 21, which was recycled to the second recontacting step, were separated.

Table 2 records compositions of the various streams generated by the process of Example 1.

TABLE 2

| | Stream (20) (Kg/h) | Stream (23) (Kg/h) | Stream (32) (Kg/h) | Stream (26) (Kg/h) |
|---|---|---|---|---|
| H2 | 7 156 | 44 | 0.02 | <0.02 |
| C1 | 1 426 | 112 | 2 | 0 |
| C2 | 1 766 | 630 | 144 | 0 |
| C3 | 1 607 | 1 121 | 1 931 | 1 |
| C4 branched | 430 | 243 | 1 788 | 379 |
| C4 linear | 52 | 12 | 2 | 1 694 |
| C5+ | 463 | 149 | 60 | 177687 |
| Total Kg/h | 13 157 | 2 437 | 5 460 | 178 945 |

TABLE 2-continued

| | Stream (20) (Kg/h) | Stream (23) (Kg/h) | Stream (32) (Kg/h) | Stream (26) (Kg/h) |
|---|---|---|---|---|
| Pressure MPa | 3.1 | 1.03 | 2.6 | 0.9 |
| Temperature ° C. | 43 | 48 | 43 | 43 |

Example 2

Example 2 illustrates the process for the treatment of a hydrocarbon feed in accordance with the invention. It differs from Example 1 in that the gas 23 obtained from the second recontacting step was recycled to the first recontacting step in its entirety. The operating conditions mentioned in Example 1 were kept the same in Example 2.

Table 3 summarizes the compositions of the various streams generated by the process of Example 2.

TABLE 3

| | Stream (20) (Kg/h) | Stream (32) (Kg/h) | Stream (26) (Kg/h) |
|---|---|---|---|
| H2 | 7 200 | 0.02 | <0.02 |
| C1 | 1 539 | 1 | 0 |
| C2 | 2 395 | 145 | 0 |
| C3 | 2 285 | 2 374 | 1 |
| C4 branched | 483 | 1 986 | 371 |
| C4 linear | 327 | 1 645 | 888 |
| C5+ | 463 | 69 | 177 828 |
| Total Kg/h | 14 690 | 6 221 | 179 088 |
| Pressure MPa | 3.1 | 2.6 | 0.9 |
| Temperature ° C. | 43 | 43 | 43 |

A comparison of Tables 2 and 3 shows that the process in accordance with the invention can be used to improve the recovery of hydrogen in the hydrogen-rich stream 20, gaining 7% in the recovery of $C_3$ and $C_4$ hydrocarbons in the stream 32 and 0.1% in the recovery of the $C_5^+$ cut in the stream 26.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

BRIEF DESCRIPTION OF FIGURES

FIG. 1 represents a flow diagram of a specific arrangement of the process in accordance with the invention.

The invention claimed is:

1. A process for the treatment of a hydrocarbon feed (1) containing hydrogen and hydrocarbons including $C_1$ to $C_4$ hydrocarbons, in which:

a) the hydrocarbon feed is separated into a gaseous phase (6) containing mainly hydrogen and a liquid phase (4) containing hydrocarbons;

b) a first recontacting step is carried out on the gaseous phase (6) obtained from step a) mixed with a gaseous recycling stream (23) obtained from step e) and with the liquid phase (4) obtained from step a) at a temperature of 55° C. or less;

c) the recontacting effluent from step b) is separated into a hydrogen-rich gaseous phase (15) and a liquid phase (16);

d) a second recontacting step is carried out on the liquid phase (16) obtained from step c) with a gas phase (21) obtained from step g) at a temperature of 55° C. or less;

e) the recontacting effluent obtained from step d) is separated into a gaseous phase (23) which is recycled to step b) and a liquid phase (24) containing hydrocarbons;

f) the liquid phase (24) obtained from step e) is fractionated in a fractionation column (25) in a manner such as to separate a gaseous overhead fraction (27) and a liquid bottom fraction (26) containing hydrocarbons containing more than 4 carbon atoms;

g) the gaseous overhead fraction (27) obtained from step f) is partially condensed and a liquid phase containing mainly $C_3$ and $C_4$ hydrocarbons (30) and a gaseous phase (21) which is recycled to step d) are separated out.

2. The process according to claim 1, in which the hydrocarbon feed (1) is an effluent from a catalytic reforming process.

3. The process according to claim 1, in which the separation steps c) and e) are carried out by means of a separator drum.

4. The process according to claim 1, in which the liquid bottom fraction (26) obtained from step f) is supplied to an indirect heat exchange device in order to heat the liquid phase (24) containing hydrocarbons obtained from step e).

5. The process according to claim 1, in which the first recontacting step is carried out at a temperature in the range −20° C. to 55° C.

6. The process according to claim 1, in which the second recontacting step is carried out at a temperature in the range 10° C. to 55° C.

7. The process according to claim 1, in which step b) is carried out with the gaseous phase compressed to a pressure in the range 1.6 to 4.0 MPa.

8. The process according to claim 1, in which the hydrogen-rich gaseous phase (15) and/or the liquid phase (16) obtained from step c) are supplied to at least one heat exchanger in order to cool the gas/liquid mixture at step b).

9. The process according to claim 1, in which the gaseous phase (23) from step e) contains hydrogen and $C_1$ and $C_2$ hydrocarbons and is recycled in its entirety to step b).

10. The process according to claim 1, in which the hydrocarbon feed (1) comprises hydrogen, methane and/or ethane, and $C_3$ and $C_4$ hydrocarbons.

* * * * *